US008844643B2

(12) United States Patent
Mickelsen et al.

(10) Patent No.: US 8,844,643 B2
(45) Date of Patent: Sep. 30, 2014

(54) FIREPROOF SYSTEMS WITH LOCAL HEAT SHIELDS FOR AIRCRAFT ENGINES

(75) Inventors: Justin C. Mickelsen, Phoenix, AZ (US); Martin C. Baker, Budd Lake, NJ (US)

(73) Assignee: Honeywell International Inc., Morristown, NJ (US)

( * ) Notice: Subject to any disclaimer, the term of this patent is extended or adjusted under 35 U.S.C. 154(b) by 853 days.

(21) Appl. No.: 13/042,953

(22) Filed: Mar. 8, 2011

(65) Prior Publication Data

US 2012/0227370 A1 Sep. 13, 2012

(51) Int. Cl.

| | |
|---|---|
| ***A62C 3/07*** | (2006.01) |
| ***A62C 3/08*** | (2006.01) |
| *A62C 2/06* | (2006.01) |

(52) U.S. Cl.

CPC . *A62C 3/08* (2013.01); *A62C 2/065* (2013.01); *Y10S 428/92* (2013.01)

USPC ..... 169/62; 169/9; 169/11; 169/26; 169/49; 169/54; 169/70; 60/39.091; 244/129.2; 428/920

(58) Field of Classification Search

CPC ..... A62C 35/023; A62C 13/006; A62C 99/0018; A62C 35/645; A62C 8/08; A62C 2/06; A62C 3/00; A62C 3/0292; A62C 3/08; A62C 35/02; A62C 99/099; F02C 7/25; F23N 2041/20; F23R 3/60; B64D 37/32; B32B 5/26; A41D 31/0027

USPC ..... 169/9, 11, 19, 26, 45–49, 54, 62, 65, 169/70; 60/30.091, 39.11, 779, 796; 244/121, 129.2; 428/920, 921

See application file for complete search history.

(56) References Cited

U.S. PATENT DOCUMENTS

| | | | | |
|---|---|---|---|---|
| 3,710,855 | A * | 1/1973 | Osorio | 169/26 |
| 3,874,458 | A * | 4/1975 | Williams | 169/65 |
| 4,087,624 | A * | 5/1978 | Hitchcock | 169/48 |
| 5,174,714 | A | 12/1992 | Plemmons et al. | |
| 5,201,846 | A | 4/1993 | Sweeney | |
| 5,335,490 | A | 8/1994 | Johnson et al. | |
| 5,518,075 | A * | 5/1996 | Williams | 169/65 |
| 6,105,677 | A * | 8/2000 | Stager | 169/26 |
| 6,811,122 | B2 * | 11/2004 | Aramburu et al. | 60/39.11 |
| 7,458,209 | B2 | 12/2008 | Hofmann et al. | |
| 7,472,758 | B1 * | 1/2009 | Stevens et al. | 169/43 |
| 7,614,845 | B2 | 11/2009 | Adam et al. | |
| 2005/0091984 | A1 | 5/2005 | Czachor | |

* cited by examiner

*Primary Examiner* — Steven J Ganey

(74) *Attorney, Agent, or Firm* — Ingrassia Fisher & Lorenz, P.C.

(57) ABSTRACT

A local fire shield is provided for protecting an attachment point of a fireproof system in an engine during a fire event. The local fire shield includes a mounting plate mounted on the attachment point; and a cover coupled to the mounting plate for covering the attachment point during the fire event.

14 Claims, 5 Drawing Sheets

FIREPROOF SYSTEMS WITH LOCAL HEAT SHIELDS FOR AIRCRAFT ENGINES

TECHNICAL FIELD

The present invention relates to gas turbine engines, and more particularly relates to fireproof systems used in gas turbine engines.

BACKGROUND

A gas turbine engine is used to power various types of vehicles and systems. A particular type of gas turbine engine that may be used to power aircraft is a turbofan gas turbine engine. A turbofan gas turbine engine may include, for example, five major sections: a fan section, a compressor section, a combustor section, a turbine section and an exhaust section.

The fan section is positioned at the inlet section of the engine and includes a fan that induces air from the surrounding environment into the engine and accelerates a fraction of this air toward the compressor section. The compressor section raises the pressure of the air it receives from the fan section and directs a majority of the high pressure air into the combustor section. In the combustor section, the high pressure air is mixed with fuel and combusted. The high-temperature combusted air is then directed into the turbine section where it expands through and rotates each turbine to drive various components within the engine or aircraft. The air is then exhausted through a propulsion nozzle disposed in the exhaust section.

In order to meet certification requirements, portions of aircraft, such as the engines, are required to be able to function for a specific period of time when exposed to fire, for example in the event of an engine fire. As such, portions of the engine are provided with fireproof systems, such as firewalls or fire resistant panels. To maximize protection or to meet certification requirements, convention techniques include increasing the thickness of the fire resistant panels or adding additional structures. However, these techniques typically increase the overall weight of the engine, which may undesirably decrease engine thrust to weight efficiency.

Accordingly, it is desirable to provide fireproofing techniques for improved performance but without unduly increasing the weight of the engine. Furthermore, other desirable features and characteristics of the present invention will become apparent from the subsequent detailed description of the invention and the appended claims, taken in conjunction with the accompanying drawings and this background of the invention.

BRIEF SUMMARY

In accordance with an exemplary embodiment, a local fire shield is provided for protecting an attachment point of a fireproof system in an engine during a fire event. The local fire shield includes a mounting plate mounted on the attachment point; and a cover coupled to the mounting plate for covering the attachment point during the fire event.

In accordance with another exemplary embodiment, a fireproof system for protecting a structure during a fire event is provided. The system includes a fire resistant panel configured to be mounted on a first side of the structure at an attachment point; a local fire shield having a mounting plate defining an attachment opening and configured to be mounted on a second side of the structure at the attachment point and a cover coupled to the mounting plate for covering the attachment point; and a fastener extending through the mounting plate at the attachment opening and the fire resistant panel at the attachment point such that the local fire shield and the fire resistant panel are fastened to the structure with the fastener.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Broadly, exemplary embodiments discussed herein provide improved fireproof systems for gas turbine engines. An exemplary fireproof system includes a fire resistant panel mounted on a structure to be protected at an attachment point. The fireproof system further includes a local heat shield with a mounting plate mounted on the structure to which the fire resistant panel is also mounted at the attachment point and a cover coupled to the mounting plate and at least partially covering the attachment point. In addition to the fire protection provided by the cover, a fire retardant agent may be disposed within the local heat shield and activated during the fire event to suppress the fire, particularly in the area of the attachment point. The fire retardant could be applied to the inside surface, outside surface or both surfaces of the cover.

Figure 1:
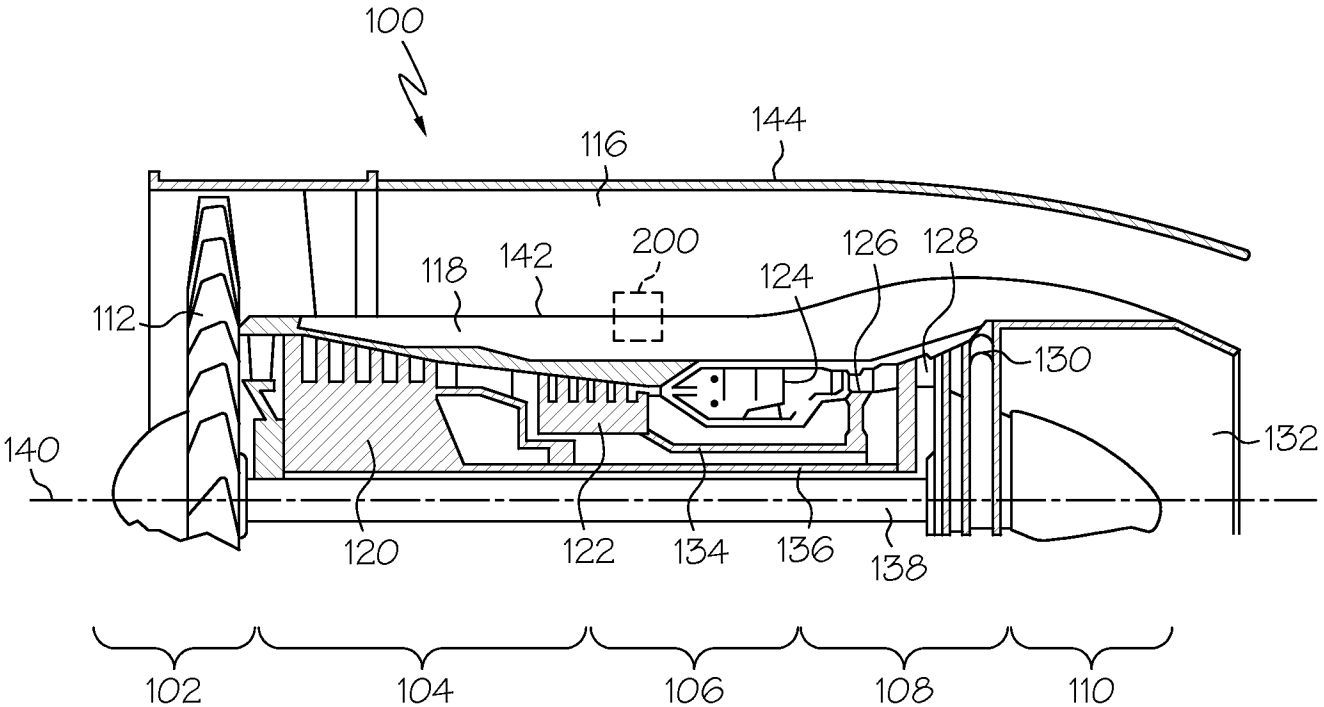
FIG. 1 is a partial, cross-sectional view of a gas turbine engine in accordance with an exemplary embodiment.

FIG. 1 is a partial, cross-sectional view of a gas turbine engine 100 in accordance with an exemplary embodiment with the remaining portion of the gas turbine engine 100 being axi-symmetric about a longitudinal axis 140. In the depicted embodiment, the gas turbine engine 100 is an annular multi-spool turbofan gas turbine jet engine 100 within an aircraft, although other arrangements and uses may be provided. The engine 100 may be, for example, an auxiliary power unit ("APU").

The engine 100 includes fan section 102, a compressor section 104, a combustor section 106, a turbine section 108, and an exhaust section 110. The fan section 102 includes a fan 112 mounted on a rotor 114 that draws air into the engine 100 and accelerates it. A fraction of the accelerated air exhausted from the fan 112 is directed through a bypass duct 116 and the remaining fraction of air exhausted from the fan 112 is directed into the compressor section 104. The bypass duct 116 is generally defined by an inner wall (or casing) 142 and an outer wall (or casing) 144.

In the embodiment of FIG. 1, the compressor section 104 includes an intermediate pressure compressor 120 and a high pressure compressor 122. However, in other embodiments, the number of compressors in the compressor section 104 may vary. In the depicted embodiment, the intermediate pressure compressor 120 and the high pressure compressor 122 sequentially raise the pressure of the air and direct a majority of the high pressure air into the combustor section 106. A fraction of the compressed air bypasses the combustor section 106 and is used to cool, among other components, turbine blades in the turbine section 108 within interior area 118. The interior area 118 is generally defined by the inner wall 142 and the interior components of the engine 100, such as the compressors 120 and 122.

In the combustor section 106, which includes an annular combustor 124, the high pressure air is mixed with fuel and combusted. The high-temperature combusted air is then directed into the turbine section 108. In the embodiment of FIG. 1, the turbine section 108 includes three turbines disposed in axial flow series, namely, a high pressure turbine 126, an intermediate pressure turbine 128, and a low pressure turbine 130. However, it will be appreciated that the number of turbines, and/or the configurations thereof, may vary. In the embodiment depicted in FIG. 1, the high-temperature combusted air from the combustor section 106 expands through and rotates each turbine 126, 128, and 130. The air is then exhausted through a propulsion nozzle 132 disposed in the exhaust section 110. As the turbines 126, 128, and 130 rotate, each drives equipment in the engine 100 via concentrically disposed shafts or spools. Specifically, the high pressure turbine 126 drives the high pressure compressor 122 via a high pressure spool 134, the intermediate pressure turbine 128 drives the intermediate pressure compressor 120 via an intermediate pressure spool 136, and the low pressure turbine 130 drives the fan 112 via a low pressure spool 138.

In order to meet certification requirements, portions of aircraft, such as the engine 100, are required to be able to function for a specific period of time when exposed to fire, for example during a fire event. As such, aircraft typically include fireproof systems that function to isolate different areas (or zones) of the engine 100 such that a fire event in one area will not spread into another area. As used herein, the term fireproof refers to fire protection for a subject component or system that satisfies a designated requirement or regulation, such as FAA requirements for aircraft. Such requirements typically require that the fireproof systems are capable of providing protection from a fire event at a predetermined temperature for a predetermined amount of time. In one exemplary embodiment, a fireproof system may be installed in a portion such as portion 200 of FIG. 1 to prevent or inhibit a fire event from spreading from the outboard side of the outer wall 144 to the inner wall 142, i.e., to render this portion 200 of the aircraft as fireproof according to the applicable standard.

Figure 2:
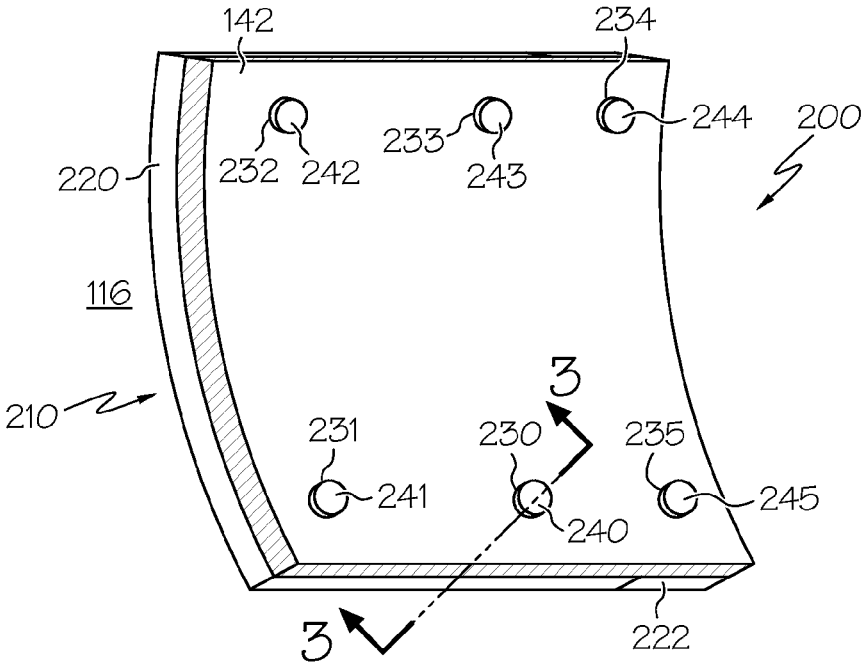
FIG. 2 is a partial isometric view of a fireproof system the gas turbine engine of FIG. 1 in accordance with an exemplary embodiment.

FIG. 2 is a partial isometric view of the portion 200 in the gas turbine engine 100 of FIG. 1 and particularly shows a fireproof system (or "fireproofing" system or "fire protection" system) 210 in accordance with an exemplary embodiment. The fireproof system 210 prevents or inhibits a fire event from being fed through a breach in the bypass duct 116, and may also be considered a fire suppression system or a fire containment system. In general, the fireproof system 210 may be installed or incorporated into any location in which fireproofing is desired, including other locations within the engine 100. As noted above, both of the interior area 118 and the bypass duct 116 are at least partially defined by the inner wall 142. As such, the fireproof system 210 is installed on the inner wall 142 and includes at least one fire resistant panel 220 and 222 and at least one local heat shield 240-245.

The fire resistant panels 220 and 222 are generally planar in shape and may be contoured to match the inner wall 142. The fire resistant panels 220 and 222 are secured to a first side the inner wall 142 at attachment points or structures 230-235. In the exemplary embodiment, two fire resistant panels 220 and 222 are adjacent to one another on the inner wall 142, although any number and arrangement of fire resistant panels 220 and 222 may be provided. Similarly, any number of attachment points 230-235 may be provided. For example, the fire resistant panel 220 has four attachment points 230-233, which includes one at each corner, and the fire resistant panel 222 has two attachment points 234 and 235, which includes one at each longitudinal end.

The fire resistant panels 220 and 222 are generally configured to substantially withstand a nearby fire largely intact, i.e., the fire resistant panels 220 and 222 are not consumed by direct contact with fire for a predetermined amount of time. The fire resistant panels 220 and 222 protect the inner wall 142 during a fire event by providing a physical and thermal barrier between a fire event and the inner wall 142 or between a fire event and the bypass duct 116.

The fire resistant panels 220 and 222 may be manufactured from an insulating and/or flame retardant material such as fiberglass. Other suitable materials may include ceramic, silicone rubber, carbon, silica-alumina, basalt, silicon carbide, zirconium oxide, nitride materials, magnesia, or other types of materials. Further examples of suitable material for the fire resistant panels 220 and 222 include carbon fiber, polymer matrix composites (PMCs), ceramic matrix composites (CMCs), and metal matrix composites (MMC), each for a wide variety of fibers including carbon, graphite, fiberglass, aramid, and polyethylene. The fire resistant panels 220 and 222 may be a composite and, in at least one exemplary embodiment, structurally self-supporting. In one embodiment, the fire resistant panels 220 and 222 may only be a single layer although multiple layers may be provided. Additional treatments and coatings may be provided to the fire resistant panels 220 and 222.

In conventional systems, the mechanism for installing a fire resistant panel may deteriorate faster than the fire resistant panel itself. For example, if the fastener that mounts a fire resistant panel onto a surface fails, such as if the fastener is melted, the fire resistant panel may become detached from the surface, thereby rendering the fire resistant panel unsuited for its intended purpose. In such an event, the fire may breach the surface at the through hole previously occupied by the fastener and fire resistant panel. Accordingly, local heat shields 240-245 are mounted on a second side of the inner wall 142, i.e., on the side opposite the fire resistant panels 220 and 222, at each of the attachment points 230-235 of the fire resistant panels 220 and 222 to mitigate the adverse impact of a fire event in these areas, as described in greater detail below. Referring briefly again to FIG. 1, in another embodiment, fire resistant panels, such as fire resistant panels 220 and 222, are mounted on the first side of outer wall 144, and local heat shields, such as heat shields 240-245, are mounted on the second side of outer wall 144. In this exemplary embodiment, the fire resistant panels are mounted on the side of outer wall 144 facing the bypass duct 116.

Figure 3:
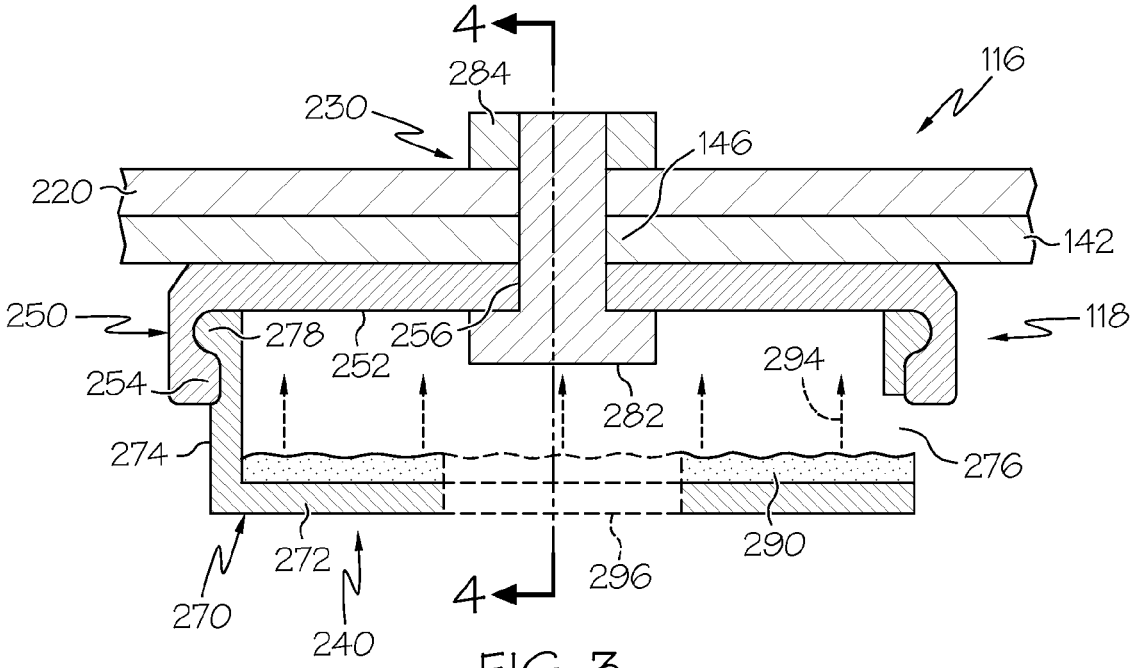
FIG. 3 is a first cross-sectional view of a local heat shield in the fireproof system of FIG. 2 through line 3-3 in accordance with a first exemplary embodiment.
Figure 4:
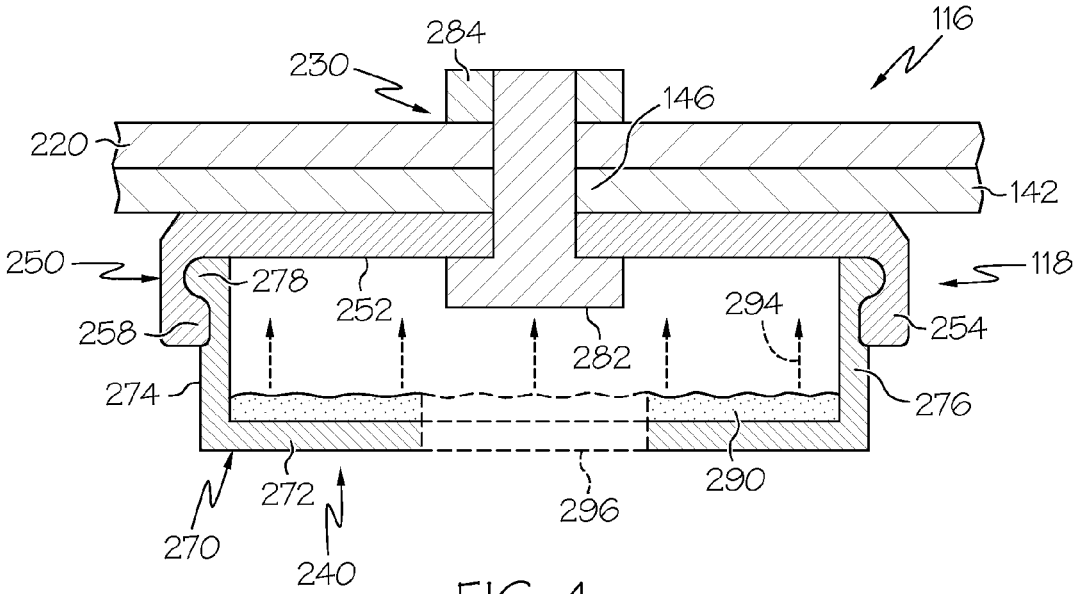
FIG. 4 is a second cross-sectional view of the local heat shield of FIG. 3.
Figure 5:
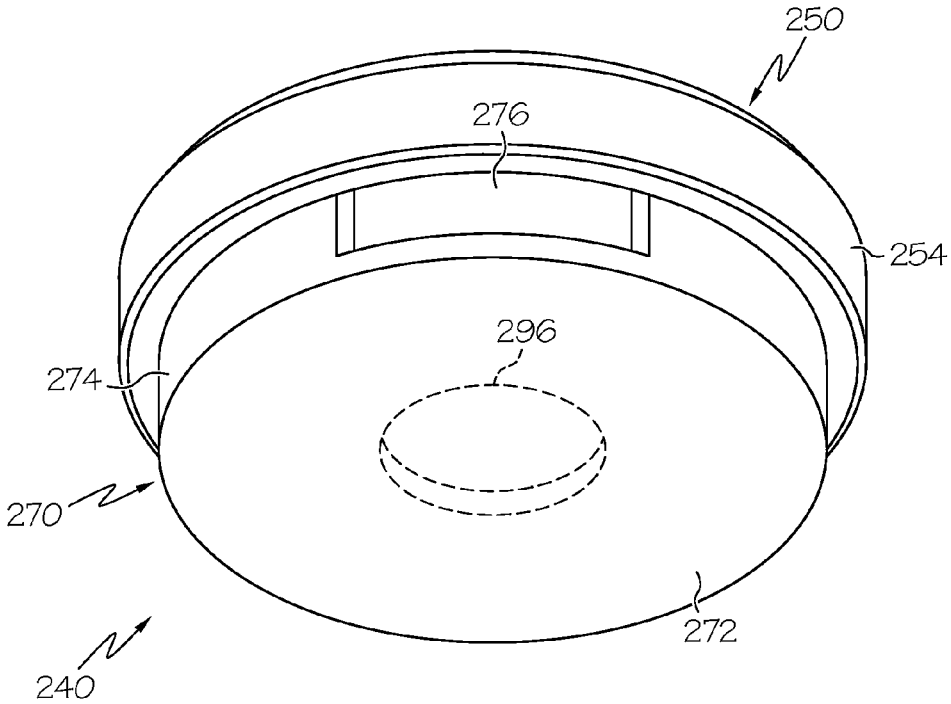
FIG. 5 is an isometric view of the local heat shield of FIG. 3.

FIG. 3 is a first partial cross-sectional view a local heat shield 240 of the fireproof system 210 of FIG. 2 along line 3-3 in accordance with a first exemplary embodiment. FIG. 4 is a second cross-sectional view of the local heat shield 240 along line 4-4 in FIG. 3. In general, FIG. 4 is an orthogonal cross-sectional view relative to the view of FIG. 3. FIG. 5 is an isometric view of the local heat shield 240 of FIGS. 3 and 4 prior to installation as part of the fireproof system 210. FIGS. 3-5 are collectively referenced below in the discussion of the local heat shield 240 of the first exemplary embodiment. Although the local heat shield 240 is referred to as a "heat shield" that functions to protect an underlying structure during a fire event, the local heat shield 240 may also be considered fire resistant, fire retardant, or fireproof depending on the construction, environment, and intended function.

FIGS. 3 and 4 particularly illustrates a portion of the fireproof system 210 that includes the fire resistant panel 220 and the local heat shield 240, although the discussion below may be applicable to the fire resistant panel 222 and the other local heat shield 241-245. The local heat shield 240 is mounted on a side opposite to the fire resistant panel 220 at the attachment point 230, which is typically embodied as an attachment opening extending through the fire resistant panel 220. In general, the local heat shield 240 and the fire resistant panel 220 are mounted within the inner wall 142, i.e., within the interior area 118. However, in other embodiments, the local heat shield 240 and the fire resistant panel 220 may be mounted on the other side of the inner wall 142, i.e., on the same side as the fire resistant panel 220. Further embodiments may have local heat shields 240 and fire resistant panels 220 mounted on both sides of the inner wall 142.

In the depicted exemplary embodiment, the local heat shield 240 includes a mounting plate 250 and a cover 270. As best shown in FIGS. 3 and 4, the mounting plate 250 generally includes a base 252 and a lip 254 extending around the perimeter of the base 252. As best shown in FIG. 5, the mounting plate 250 is generally cylindrical or circular, although any suitable shape may be provided. Similarly, the base 252 of the mounting plate 250 is generally flat, although the base 252 may have a curvature, particularly to match the inner wall 142.

The mounting plate 250 is mounted onto the inner wall 142 for the local heat shield 240 at the attachment point 230 of the fire resistant panel 220. In this exemplary embodiment, the base 252 of the mounting plate 250 defines an opening 256 that cooperates with a threaded screw 282 and a corresponding nut 284 to secure the mounting plate 250. Particularly, the screw 282 extends through the opening 256 in the base 252 of the mounting plate 250, through an opening 146 in the inner wall 142, through the attachment point 230 of the fire resistant panel 220, and into the bypass duct 116. The nut 284 engages the end of the screw 282 to secure the fireproof system 210, including the fire resistant panel 220 and the local heat shield 240, to the inner wall 142. Although, the screw 282 and nut 284 are shown, the mounting mechanism may be any suitable mechanism, including clips, inserts, tabs, and rivets. In one exemplary embodiment, the screw 282 may be reversed and the nut 284 may engage the screw 282 inside the local heat shield 240.

The cover 270 is generally cylindrical with a shape and circumference that generally matches the shape and circumference to the mounting plate 250. The cover 270 is defined by a casing wall 272 and a side wall 274 that extends along the perimeter of the casing wall 272. In the depicted embodiment, the casing wall 272 is generally parallel to the base 252 of the mounting plate 250 and perpendicular to the side wall 274. As described below, the cover 270 generally at least partially covers the screw 282, and thus, the attachment point 230.

The mounting plate 250 and cover 270 may be fabricated from any suitable materials that are compatible with the environment of the engine 100 and particularly that provide some degree of fireproof protection. Representative materials may include stainless steel or titanium, although other materials may be provided. Similarly, any suitable thickness may be provided, for example, about 0.01-0.1 inches or greater depending on weight and protection considerations. In one exemplary embodiment, the thickness of the mounting plate 250 and/or the cover 270 may be about 0.015 inches.

The mounting plate 250 and cover 270 are configured to be detachably coupled to one another in an installed condition and during engine operation. Particularly, the perimeter lip 254 of the mounting plate 250 may define a first fastener 258 that mates with a second fastener 278 on the side wall 274 such that the cover 270 may be fastened to the mounting plate 250. The fasteners may be any suitable fastening mechanism, including the snap or detent coupling shown in FIGS. 3 and 4. As such, during installation, the mounting plate 250 is secured to the inner wall 142 (and the fire resistant panel 220 through the inner wall 142) with the screw 282 and nut 284, as discussed above. The cover 270 is then secured into place on the mounting plate 250 by snap pressing the respective fasteners 258 and 278 together. In other embodiments, the depicted fasteners 258 and 278 may be modified or replaced by other fastening mechanisms, such as cooperating screw threads, slide couplings, or straps. The cover 270 may be removed from the mounting plate 250 by pulling the cover 270 away from the mounting plate 250, either by hand or with a tool, such that the fasteners 258 and 278 release one another.

As particularly shown in FIGS. 3 and 5, the side wall 274 may define an opening 276 that provides access to the screw 282, for example, during maintenance of the fireproof system 210. The opening 276 may also provide a leverage point such that the cover 270 can be removed from the mounting plate 250 by hand or with a tool, as discussed above. As particularly shown in FIGS. 4 and 5, in an alternate embodiment, the casing wall 272 defines an opening 296 that provides access to the screw 282. The access opening 296 may be provided in lieu of the opening 276 or in addition to the opening 276.

The local heat shield 240 may further include a fire retardant agent 290. The fire retardant agent 290, in the inactive condition shown in FIGS. 3 and 4, is a solid composition selected for fire retardant properties. Suitable examples are discussed below. The fire retardant agent 290 is additionally selected to maintain a solid state in the inactive condition until the local heat shield 240 is exposed to the elevated temperatures of a fire, at which time the fire retardant agent 290 transitions into an active condition.

Accordingly, upon installation, the local heat shield 240 is mounted at the attachment point 230, which may otherwise be susceptible to an issue during a fire event. However, during such a fire event, the local heat shield 240 protects the attachment point 230 and the screw 282. Particularly, the material of the cover 270 is fireproof to protect the attachment point 230. Additionally, during a fire event, the fire retardant agent 290 is activated and expands in the direction indicated by arrows 294 and further functions to protect the attachment point 230.

In one exemplary embodiment, the fire retardant agent 290 in made up of a single component that expands and that functions to suppress the fire. However, in another exemplary embodiment, the fire retardant agent 290 may include a first component that expands and that functions as a carrier for a second component that suppresses the fire. In the active condition, the fire retardant agent 290 may function as a low oxygen content gas barrier (i.e., as a gas) or a direct thermal barrier (i.e., as a foam) between the fire and the area to be protected, such as the attachment point 230. As such, the fire retardant agent 290 may be "self-foaming" or "self-sublimating" (or "self-ablative") based on the predetermined temperature. In one exemplary embodiment, the predetermined temperature is about 800-1200° F. In other exemplary embodiments, the predetermined temperature may be, for example, about 350° F., 400° F., and 900° F., although the fire retardant agent 290 may be designed for any temperature.

Examples of suitable materials that compose the fire retardant agent 290 include intumescents that expand upon application of heat to insulate an underlying substrate of an area to be protected, such as the attachment point 230. In addition to the insulating properties, materials such as intumescents may also form a protective char layer that when combined with the insulating barrier provides a higher degree of protection. In some exemplary embodiments, intumescent materials function by either chemical or physical action. Example of chemical action include the use of a carbon-rich char forming source such as glucose or a phosphoric acid source such as ammonium phosphate to promote char formation and a gas releasing intumescent source such as urea or chlorinated paraffin. Physical intumescents include expandable graphite coatings. Expandable graphite flakes are formed by the introduction of intercalants such as sulfuric or nitric acid that expand the graphite layers upon exposure to heat. The resulting expansion may be on the order of 200 times the original thickness, providing a high degree of protection to the substrate. Solid-phase retardants may form a carbonaceous char layer on the surface of the substrate that inhibits further burning. High char formation resin systems such as some epoxy and BMI formulations provide this intrinsic benefit. Other examples of suitable material that compose the fire retardant agent 290 include ablatives, perfluorocarbons (PFCs), hydrofluorocarbons (HFCs), water, $NaHCO_3$, potassium acetate, labile bromine suppressants, or inert gases such as $N_2$, $CO_2$, or Ar. One suitable example is Halon 1211 ($CF_2BrCl$) that in the active condition displaces the oxygen feeding the fire and additionally generates Br and Cl atoms that interfere with flame chemistry. Generally, no propellant is necessary, but such distribution aids may be provided. Additionally, one or more intumescents or other materials may be combined to select desirable combinations of expansion characteristics and fire retardant characteristics. The base components of the fire retardant agent 290 may be selected from commercially available sources.

The fire retardant agent 290 may be maintained in the cover 270 in the supported in the cover 270 in the inactive state in a number of ways. For example, the fire retardant agent 290 may include a binder to adhere the fire retardant agent 290 to the cover 270 or the fire retardant agent 290 itself may have suitable adhesion properties to stay in the inactive state in the cover 270. In general, any suitable mechanism, including physical mechanisms, may be provided. Exemplary binders may include adhesives such as epoxy or silicone that do not interfere with the transition of the fire retardant agent 290 from the inactive state to the active state. Although the fire retardant agent 290 is only shown within the cover 270, the fire retardant agent 290 may be provided outside of the cover 270, such as on the casing wall 272 on a side opposite the base 252 or outside of the side wall 274.

Although the local heat shield 240 is cylindrical, any shape may be provided, including square or irregular. Additionally, the local heat shield 240, particularly the cover 270, may have any suitable height and diameter. For example, the shape of the local heat shield 240 may be based on the size of the attachment point 230, characteristics of the area to be protected, sizing characteristics with respect to other components in the engine 100, and weight. In one exemplary embodiment, the local heat shield 240 may have a diameter of approximately 1 to 4 inches and a depth of approximately 0.25 to 2 inches. In general, the local heat shield 240, as depicted, has a generally circular cross-section. However, the local heat shield 240 is not restricted to circular cross-sectional shapes. For example, the local heat shield 240 may have a square cross-sectional shape. In other embodiments, the shape of the local heat shield 240 may be irregular to accommodate any neighboring structures, such as ribs of the inner wall 142. The local heat shield 240 may provide a standardized size and shape such that, after a fire event, the depleted local heat shield 240 may be removed and replaced, as necessary or desired.

In the depicted exemplary embodiment, the components of the local heat shield 240 are fastened together and mounted on the structure to be protected, i.e., the inner wall 142 with the screw 282, as discussed above. In other embodiments, such securement may not include a screw and/or aperture extending through the mounting plate 250. Instead, the securement may be formed by a tab or projection extending from the backside of the mounting plate (i.e., the side opposite the cover 270) that mates with a corresponding tab or attachment mechanism on the inner wall 142.

The number and arrangement of local heat shields 240-245 (FIG. 2) may be varied to optimize the desired characteristics of the fireproof system 210. Because the local heat shields 240-245 may be efficiently located, the size of the local heat shields 240-245 and the amount of fire retardant agent 290 may be minimized, or even omitted. The amount of fire retardant agent 290 and the size of the local heat shield 240 may be selected based on number of factors, including the anticipated temperature of the fire, the duration of the fire, and the size of the area to be protected. Computational fluid dynamics or test fires may be used to further optimize the fireproof system 210. Additionally, the local heat shields 240 also function in any orientation, such as for example, when a fire is located above or on one of the sides of the local heat shield 240. In a typical situation, however, the opening 276 (or opening 296) of the local heat shield 240 is oriented away from the anticipated direction of a fire to provide enhanced protection. In such a scenario, the fire would tend to "lick around" the opening 276 instead of spreading around a cover to impact the attachment opening 230.

Figure 6:
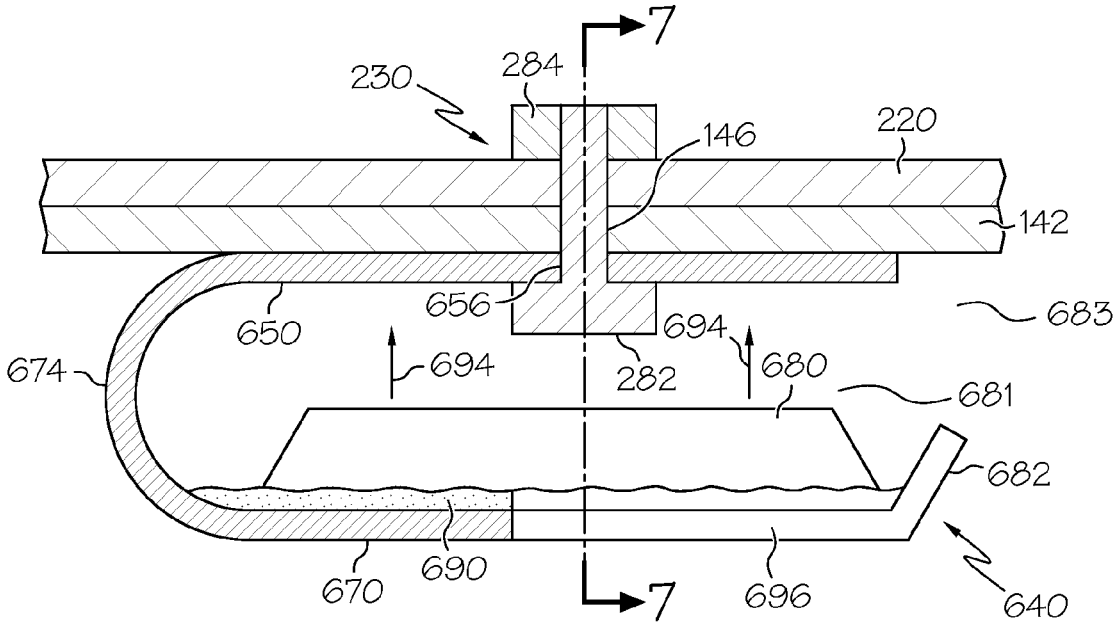
FIG. 6 is a first cross-sectional view of a local heat shield in accordance with a second exemplary embodiment.
Figure 7:
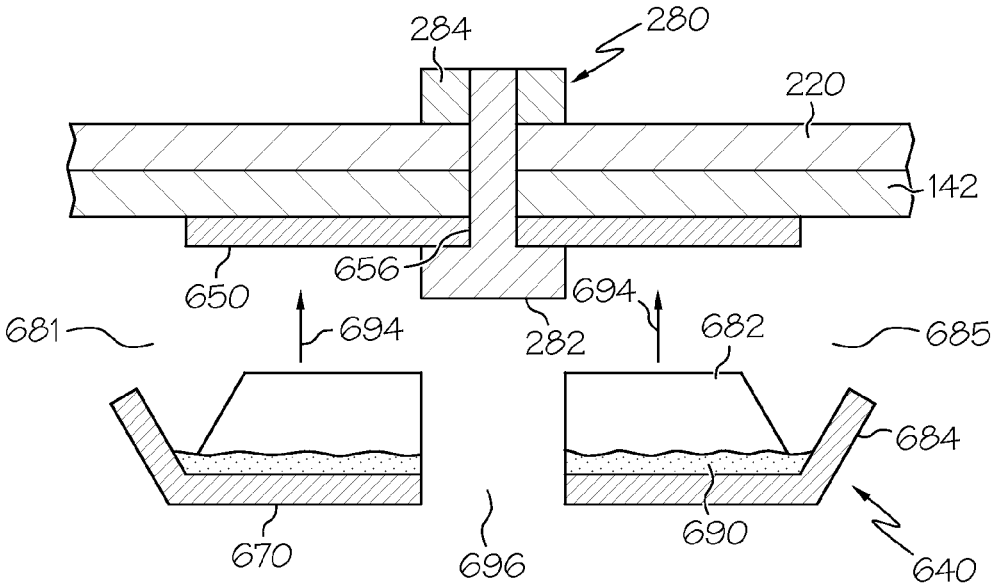
FIG. 7 is a second cross-sectional view of the local heat shield of FIG. 6.
Figure 8:
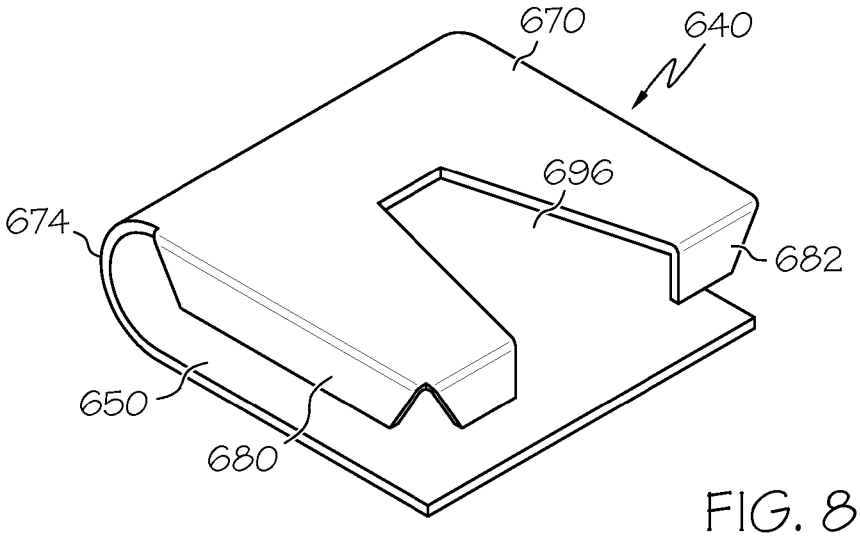
FIG. 8 is an isometric view of the local heat shield of FIG. 6.

FIG. 6 is a first cross-sectional view of a local heat shield 640 in accordance with a second exemplary embodiment that may be used in the fireproof system 210 of FIG. 2, either in lieu of or in addition to the local heat shields 240-245 discussed above. FIG. 7 is a second cross-sectional view of the local heat shield 640 of FIG. 6 along line 7-7, and FIG. 8 is an isometric view of the local heat shield 640 of FIG. 6.

As above, the local heat shield 640 includes a mounting plate 650 and a cover 670. In this exemplary embodiment, the mounting plate 650 and cover 670 are coupled together with a side wall 674. As best shown in FIG. 6, the mounting plate 650, cover 670, and side wall 674 are integral with one another (i.e., formed from a single piece of material) and form a C-shape in cross-section. The cover 670 is generally folded over the mounting plate 650 at the side wall 674. The cover 670 may have one or more flanges 680, 682, 684 that are folded down in the direction of the mounting plate 650 to function as additional side walls. The flanges 680, 682, and 684 may extend all the way to the mounting plate 650 or may leave gaps 681, 683, 685 to enable access to the interior portions of the local heat shield 640 for maintenance and the like. In an exemplary embodiment, the cover 670 may define an opening 696 for access to the screw 282. In such an embodiment, one or more of the gaps 681, 683, 685 may be omitted.

Like the mounting plate 250 (FIGS. 3-5), the mounting plate 650 may be mounted onto the inner wall 142 with a fastener. In this exemplary embodiment, the mounting plate 650 defines an opening 656 that cooperates with the threaded screw 282 and the corresponding nut 284 to secure the mounting plate 650. Particularly, the screw 682 extends through the opening 656 in the mounting plate 650, through the opening 146 in the inner wall 142, through the attachment point 230 of the fire resistant panel 220, and into the bypass duct 116. The nut 284 engages the end of the screw 282 to secure the fireproof system 210 (FIG. 2) to the inner wall 142. The mounting plate 650 is generally flat, although the mounting plate 650 may have a curvature to match any curvature of the fire resistant panel 220. The mounting plate 650 and cover 670 may be fabricated from any suitable materials that are compatible with the environment of the engine 100 and particularly that provide some degree of fireproof protection. Representative materials may include stainless steel or titanium, although other materials may be provided. As best shown in FIG. 8, the local heat shield 640 may be square shaped, although any suitable shape may be provided.

As also shown in FIGS. 6 and 7, a fire retardant agent 690 may be provided in the cover 670. As above, the fire retardant agent 690 is selected to maintain a solid state in the inactive condition until the local heat shield 640 is exposed to the elevated temperatures of a fire and the fire retardant agent 690 transitions into an active condition.

As such, upon installation, the local heat shield 640 is mounted at the attachment point 230, which may otherwise be susceptible to an issue during a fire event. However, during such a fire event, the local heat shield 640 protects the attachment opening 230 and the screw 282. Particularly, the material of the cover 670 is fireproof to protect the attachment point 230. Additionally, during a fire event, the fire retardant agent 690 is activated and expands in the direction indicated by arrows 694 and functions to further protect the attachment point 630.

Figure 9:
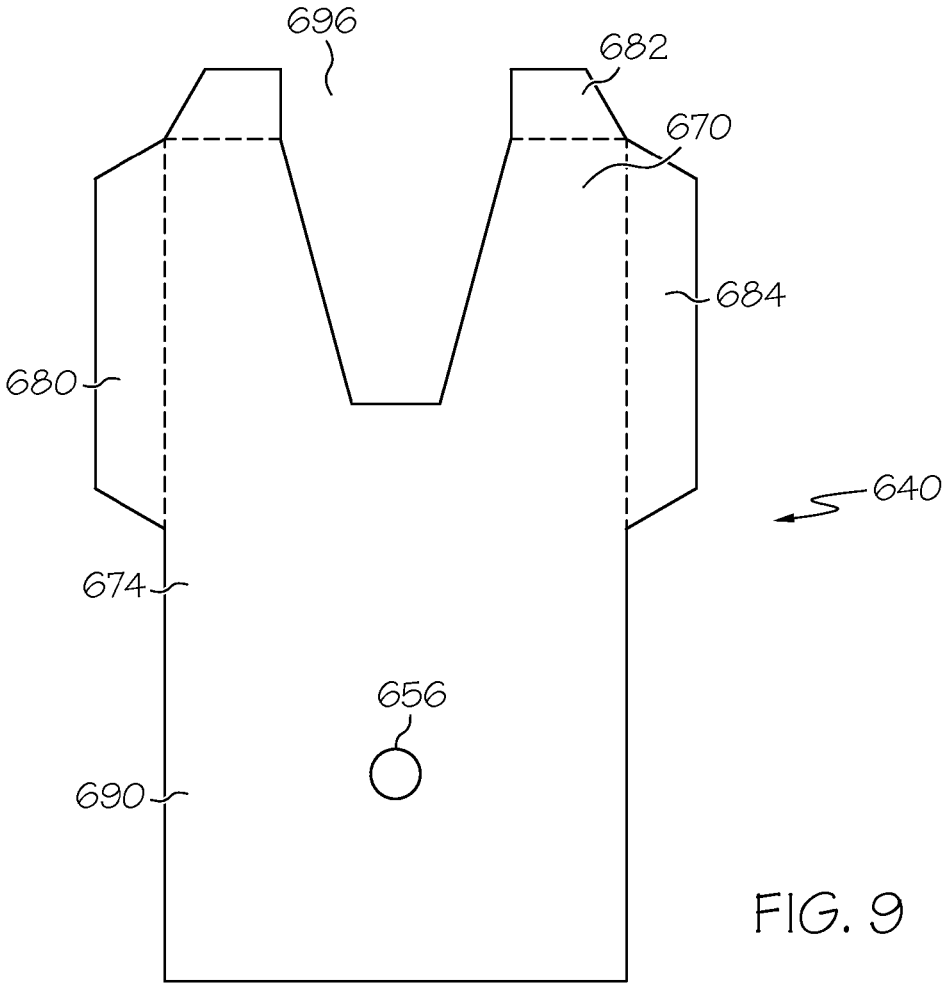
FIG. 9 is a plan view of the local heat shield of FIG. 6 in an uninstalled state.

FIG. 9 is a plan view of the local heat shield 640 of FIGS. 6-8 in an uninstalled state and more clearly shows the integral construction. As described above, to install, the mounting plate 650 is secured at the opening 656, and the cover 670 and side flanges 680, 682, and 684 are then folded over to at least partially cover the opening 656 and the underlying attachment point 230 (FIGS. 6-8).

The mounting plate 650 and cover 670 may have any suitable thickness based on considerations such as weight and desired fire protection. Similarly, the flanges 680, 682, and 684 and side wall 672 may be sized to provide the desired level of fire protection. For example, longer flanges 680, 682, and 684 that leave smaller gaps 681, 683, and 685 between the mounting plate 650 and cover 670 may provide enhanced fire protection, but may sacrifice access to the screw 282.

Accordingly, improved fireproof systems 210 have been described. The fireproof system 210 may relatively lightweight, particularly as compared to adding additional fire resistant panels. Additionally, the fireproof system 210 includes few parts and is relatively simple to implement to improve the safety of the corresponding engine 100. Unlike conventional fireproof systems, the fireproof system 210 provides fireproofing directly to desired areas without the need for additional tubing, pipe, and pumps and without the attendant costs, weight, volume, and complexity In general, the fireproof systems 210 may be implemented into any one of numerous applications in which isolation from a fire may be desired. For example, although the fireproof system 210 is depicted in an aircraft engine between two ducts, other exemplary environments may include aircraft engine nacelles, electronic cabinets, aircraft cabins, telecommunication or electrical power switching stations, fume hoods, natural gas pipelines, chemical distribution cabinets, chimneys, petrochemical refineries, and the like.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A local fire shield for protecting an attachment point of a fireproof system in an engine during a fire event, comprising:

a mounting plate mounted on the attachment point; and a cover coupled to the mounting plate for covering the attachment point during the fire event;

wherein the cover is detachably coupled to the mounting plate, wherein cover includes a first fastener and the cover includes a second fastener, the first fastener cooperating with the second fastener to detachably couple the mounting plate and the cover, and wherein first and second fasteners are snap fasteners.

2. The local fire shield of claim 1, further comprising a fire retardant agent disposed within the cover in an inactive condition and configured to transition into an active condition at a predetermined temperature during the fire event.

3. The local fire shield of claim 2, wherein the fire retardant agent is a solid in the inactive condition and a vapor in the active condition.

4. The local fire shield of claim 2, wherein the fire retardant agent is a solid in the inactive condition and a foam or solid in the active condition.

5. The local fire shield of claim 1, wherein the cover includes a side wall that defines an opening to provide access to the attachment point.

6. A fireproof system for protecting a structure during a fire event, the system comprising:

a fire resistant panel configured to be mounted on a first side of the structure at an attachment point;

a local fire shield comprising a mounting plate defining an attachment opening and configured to be mounted on a second side of the structure at the attachment point;

a cover coupled to the mounting plate for covering the attachment point;

a fastener extending through the mounting plate at the attachment opening and the fire resistant panel at the attachment point such that the local fire shield and the fire resistant panel are fastened to the structure with the fastener; and a fire retardant agent disposed within the cover in an inactive condition and configured to transition into an active condition at a predetermined temperature.

7. The fireproof system of claim 6, wherein the cover is integral with the mounting plate.

8. The fireproof system of claim 7, further comprising a first side wall integral with, and between, the cover and the mounting plate.

9. The fireproof system of claim 8, wherein the cover further comprises a first flange forming a second side wall.

10. The fireproof system of claim 9, wherein the cover further comprises a second flange forming a third side wall and a third flange forming a fourth side wall.

11. The fireproof system of claim 7, wherein the cover and the mounting plate define an opening to provide access to the attachment point.

12. The fireproof system of claim 6, wherein the cover is detachably coupled to the mounting plate.

13. The fireproof system of claim 6, wherein the cover is integral with the mounting plate, and the cover and mounting plate form a C-shape in cross section.

14. A fireproof system for protecting a structure during a fire event, the system comprising:

a fire resistant panel configured to be mounted on a first side of the structure at an attachment point;

a local fire shield comprising a mounting plate defining an attachment opening and configured to be mounted on a second side of the structure at the attachment point; and a cover coupled to the mounting plate for covering the attachment point; and a fastener extending through the mounting plate at the attachment opening and the fire resistant panel at the attachment point such that the local fire shield and the fire resistant panel are fastened to the structure with the fastener, wherein the local fire shield is a first local fire shield and the fastener is a first fastener, the fire resistant panel additionally defining a second attachment point, and the fireproof system further comprising:

a second local fire shield mounted on the fire resistant panel; and a second fastener configured to couple the second local fire shield to the fire resistant panel at the second attachment point.

* * * * *